US006561557B2

(12) United States Patent
Choi

(10) Patent No.: US 6,561,557 B2
(45) Date of Patent: May 13, 2003

(54) SYSTEM FOR OPENING AND CLOSING SLIDING DOOR

(75) Inventor: Jae-hong Choi, Kyunggi-do (KR)

(73) Assignee: Kia Motors Corporation, Seoul (KR)

( * ) Notice: Subject to any disclaimer, the term of this patent is extended or adjusted under 35 U.S.C. 154(b) by 5 days.

(21) Appl. No.: 09/782,364

(22) Filed: Feb. 13, 2001

(65) Prior Publication Data

US 2002/0060461 A1 May 23, 2002

(30) Foreign Application Priority Data

Nov. 14, 2000 (KR) ..... 2000-67376

(51) Int. Cl.[7] ..... E05B 3/00

(52) U.S. Cl. ..... 292/336.3; 292/216; 292/DIG. 46; 292/DIG. 23; 49/279; 49/460; 49/280

(58) Field of Search ..... 292/336.3, 216, 292/DIG. 46, DIG. 23, DIG. 12, DIG. 3; 49/279, 280, 31, 460

(56) References Cited

U.S. PATENT DOCUMENTS

| | | | | | |
|---|---|---|---|---|---|
| 5,361,540 | A | * | 11/1994 | Rogers et al. | 292/DIG. 46 |
| 5,605,363 | A | | 2/1997 | Kapes | |
| 6,032,987 | A | * | 3/2000 | Fukumoto et al. | 292/201 |
| 6,135,513 | A | * | 10/2000 | Hamada et al. | 292/201 |
| 2001/0030430 | A1 | * | 10/2001 | Roos | 292/216 |

* cited by examiner

*Primary Examiner*—J. J. Swann
*Assistant Examiner*—Dinesh N Melwani
(74) *Attorney, Agent, or Firm*—Davis & Bujold, P.L.L.C.

(57) ABSTRACT

Disclosed is a system for opening and closing a sliding door. When an inner handle is pivoted in a door opening direction in a state wherein a sliding door is closed, as the inner handle is pivoted from a neutral position in the door opening direction, a door-closed-status holding mechanism is unlocked by a locking controller. Also, when the inner handle is pivoted in a door closing direction in a state wherein the sliding door is opened, as the inner handle is pivoted from the neutral position in the door closing direction, a door-opened-status holding mechanism is unlocked by the locking controller.

4 Claims, 7 Drawing Sheets

110a

SYSTEM FOR OPENING AND CLOSING SLIDING DOOR

BACKGROUND OF THE INVENTION

1. Field of the Invention

The present invention relates to a system for opening and closing a sliding door which is installed in a motor vehicle, and more particularly, to a system for opening and closing a sliding door, which includes a door-opened-status holding mechanism for allowing the sliding door to be held in an opened status and at the same time, enables manipulation of an inner handle for opening and closing the sliding door to be implemented in a convenient manner.

2. Description of the Related Art

As well known in the art, a sliding door which is installed in a van or the like, is opened and closed in a manner such that the sliding door is slid rearward and forward along a side of a vehicle body. Therefore, the sliding door is advantageous in that it is easy for an occupant to get on or get off a vehicle and opening and closing of the sliding door is not interfered by surroundings.

A conventional sliding door includes a door-closed-status holding mechanism for allowing the sliding door to be held in a closed status, a locking controller which is connected to the door-closed-status holding mechanism for controlling an operation of the door-closed-status holding mechanism, an inner handle assembly and an outside handle assembly which are connected to the locking controller for releasing the closed status of the sliding door, and a door safety locking knob which is connected to the locking controller for controlling the locking controller in such a way as to allow the sliding door to be locked in the closed status. If the sliding door which is in an opened status is closed, the sliding door is securely held in the closed status by the door-closed-status holding mechanism, in such a way as not to be opened by itself. If an inner handle or an outside handle is manipulated while the door is held in the closed status, the door-closed-status holding mechanism is unlocked and thereby the closed door can be opened. If the door safety locking knob is pressed, even when the inner handle or the outside handle is manipulated with the sliding door in the closed status, the door is not willing to be opened.

However, the conventional sliding door constructed as mentioned above is encountered with a problem in that, if the door is opened in a state wherein a motor vehicle is stopped on a downward slope, since the sliding door is closed by itself while being slid by its own weight, an occupant can be damaged by the door closed by itself, and in order to prevent this situation from occurring, the occupant must bear up the opened door.

To cope with this problem, an attempt has been made in which a door-opened-status holding mechanism for allowing a sliding door to be held in an opened status is installed in the sliding door. Nowadays, this type of sliding door having the door-opened-status holding mechanism is widely used throughout the world. In this regard, locking controllers, inner handles and outside handles which are necessary to control an operation of the door-opened-status holding mechanism, have been vigorously developed.

In an example, a sliding door latch control assembly is disclosed in U.S. Pat. No. 5,605,363 assigned to Chrysler Corporation. In the sliding door latch control assembly, if an outside handle is pulled, a door-opened-status holding mechanism and a door-closed-status holding mechanism are simultaneously unlocked. Also, if a button which is provided to an inner handle, is pressed in a state wherein the inner handle is grasped, the door-opened-status holding mechanism and the door-closed-status holding mechanism are simultaneously unlocked.

In U.S. Pat. No. 5,605,363, due to the fact that the outside handle is manipulated while a manipulator stands outside, a natural posture of the manipulator is not deteriorated. However, in the case of the inner handle, in order to open or close the sliding door, because the manipulator must slide the sliding door in a limited space while grasping the inner handle with one hand and pressing the button, cumbersomeness is induced upon manipulating the inner handle for opening or closing the sliding door.

In another attempt, if an inner handle is pulled in the same manner as an outside handle, a door-opened-status holding mechanism and a door-closed-status holding mechanism are simultaneously unlocked. However, this attempt still suffers from defects in that a procedure for opening and closing a sliding door is more complicated than the sliding door latch control assembly described in U.S. Pat. No. 5,605,363.

SUMMARY OF THE INVENTION

Accordingly, the present invention has been made in an effort to solve the problems occurring in the related art, and an object of the present invention is to provide a system for opening and closing a sliding door, which enables manipulation of an inner handle for opening and closing the sliding door to be implemented in a convenient manner.

In order to achieve the above object, according to one aspect of the present invention, there is provided a system for opening and closing a sliding door, characterized in that, when an inner handle is pivoted in a door opening direction in a state wherein a sliding door is closed, as the inner handle is pivoted from a neutral position in the door opening direction, a door-closed-status holding mechanism is unlocked by a locking controller; and that, when the inner handle is pivoted in a door closing direction in a state wherein the sliding door is opened, as the inner handle is pivoted from the neutral position in the door closing direction, a door-opened-status holding mechanism is unlocked by the locking controller.

BRIEF DESCRIPTION OF THE DRAWINGS

The above objects, and other features and advantages of the present invention will become more apparent after a reading of the following detailed description when taken in conjunction with the drawings, in which.

DETAILED DESCRIPTION OF PREFERRED EMBODIMENTS

Figure 1:
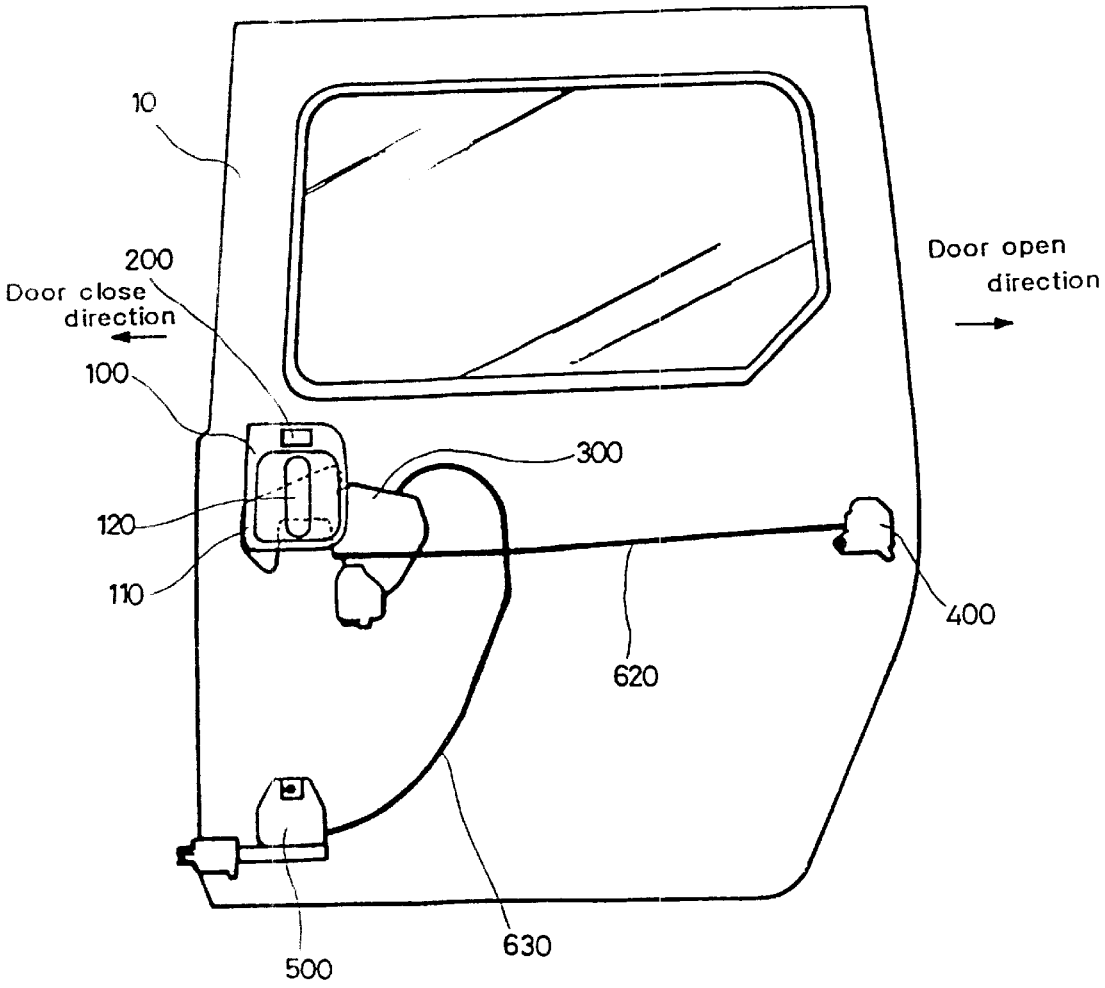
FIG. 1 is a schematic front view illustrating a system for opening and closing a sliding door in accordance with an embodiment of the present invention.

Reference will now be made in greater detail to a preferred embodiment of the invention, an example of which is illustrated in the accompanying drawings. Wherever possible, the same reference numerals will be used throughout the drawings and the description to refer to the same or like parts.

FIG. 1 is a schematic front view illustrating a system for opening and closing a sliding door in accordance with an embodiment of the present invention. The system for opening and closing a sliding door according to the present invention includes a door-closed-status holding mechanism 400 for allowing the sliding door 10 to be held in a closed status, a door-opened-status holding mechanism 500 for allowing the sliding door 10 to be held in an opened status, a locking controller 300 which is connected to the door-closed-status holding mechanism 400 and the door-opened-status holding mechanism 500 so as to control operations of the door-closed-status holding mechanism 400 and the door-opened-status holding mechanism 500, an inner handle assembly 100 and an outside handle assembly (not shown) which operate the locking controller 300 so as to release the closed status of the sliding door 10 as occasion demands, and a door safety locking knob 200 which is connected to the locking controller 300 so as to control an operation of the locking controller 300.

Schematically describing interlocked operations of the above-described component elements which constitute the system for opening and closing a sliding door according to the present invention, as an inner handle 120 and an outside handle which are respectively provided to the inner handle assembly 100 and the outside handle assembly, are manipulated, the locking controller 300 which is connected to the inner handle assembly 100 and the outside handle assembly, is operated. By this, the door-closed-status holding mechanism 400 and the door-opened-status holding mechanism 500 are selectively unlocked. Also, as the door safety locking knob 200 is manipulated, the operation of the locking controller 300 which is connected to the door safety locking knob 200, is controlled. As a consequence, the operation of the locking controller 300 by the inner handle 120 or the outside handle is disabled in a selective manner.

Figure 2A:
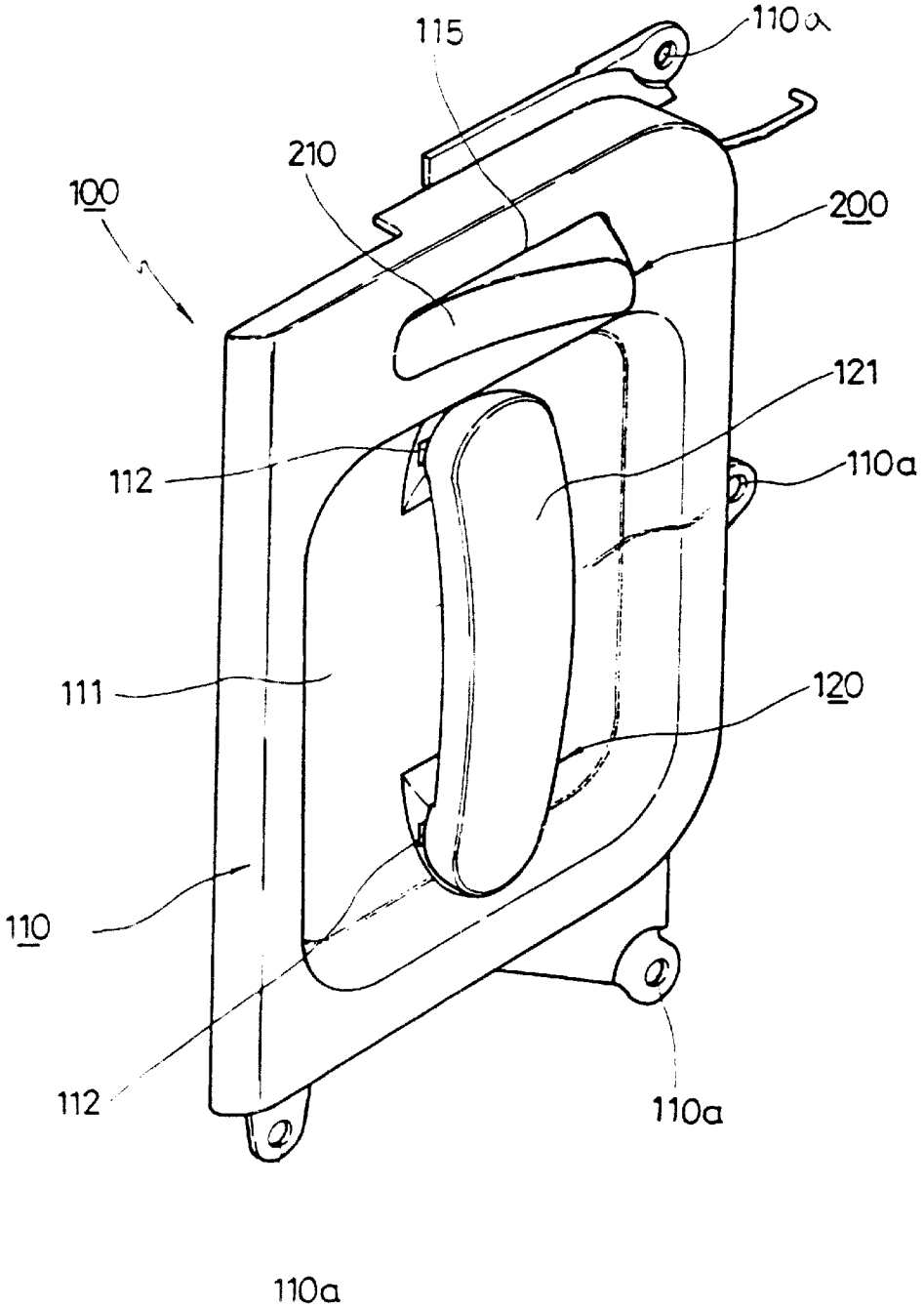
FIGS. 2*a* and 2*b* are respectively front and rear perspective views illustrating an inner handle assembly of FIG. 1.
Figure 2B:
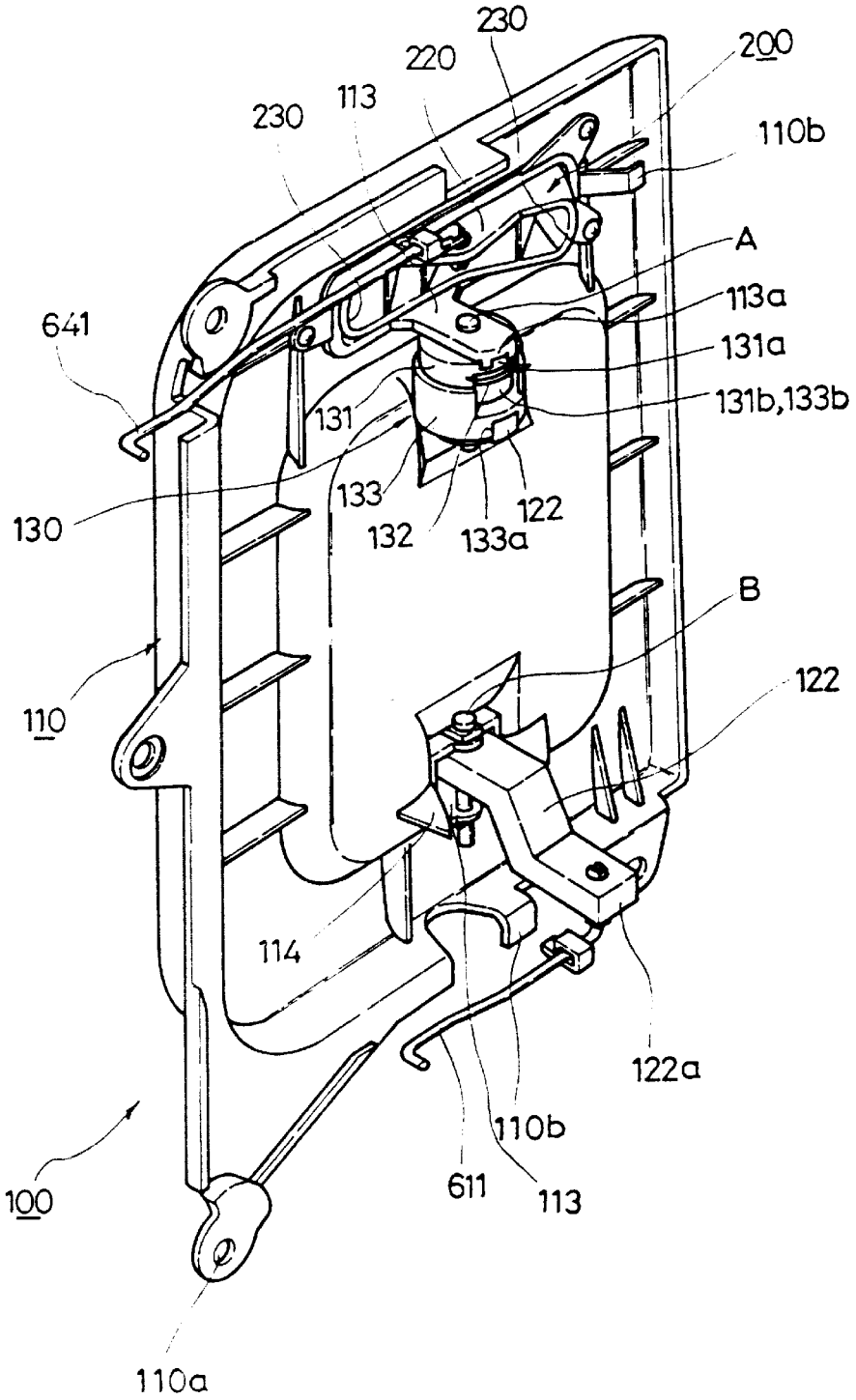

FIGS. 2*a* and 2*b* are respectively front and rear perspective views illustrating the inner handle assembly of FIG. 1. Referring to FIGS. 2*a* and 2*b*, the inner handle assembly 100 includes a housing 110, the inner handle 120, and an inner handle operation control mechanism 130. The housing 110 has a plurality of first locking parts 110*a* and a plurality of assembling protrusions 110*b*. The housing 110 is assembled to an inner surface of the sliding door 10 by the medium of locking means such as screws, etc. The inner handle 120 is rotatably fastened to the housing 110. The inner handle operation control mechanism 130 controls an operation of the inner handle 120 in a manner such that the inner handle 120 is always returned to its neutral position. An inner surface of the housing 110 which inner surface is exposed to a cabin defined in a motor vehicle, is defined with an inner handle receiving recess 111 and a pair of inserting holes 112 through which both ends 122 of the inner handle 120 are inserted, respectively. A pair of hinge connecting parts 113 for fastening both ends 122 of the inner handle 120 are formed on an outer surface of the housing 110, in a manner such that the pair of hinge connecting parts 113 are positioned upward and downward of the pair of inserting holes 112, respectively, and are opposed to each other. A pair of first stoppers 114 for controlling a rotating angle of the inner handle 120 are also formed on the outer surface of the housing 110 at both sides, respectively, of the inserting hole 112 which is defined adjacent to a lower end of the housing 110. A first fastening part 113*a* which has prominences and depressions, is formed on a lower surface of the hinge connecting part 113 which is positioned upward of the inserting hole 112 defined adjacent to an upper end of the housing 110. A knob insertion opening 115 is defined through a portion of the housing 110 above the inner handle receiving recess 111. The door safety locking knob 200 is inserted through the knob insertion opening 115 in a manner such that the door safety locking knob 200 can be rotated about a separate hinge shaft (not shown). Due to the fact that the separate hinge shaft is located at a center portion of the door safety locking knob 200, the door safety locking knob 200 can be rotated about the separate hinge shaft along both clockwise and counterclockwise directions. A pushing part 210 is formed on an inner surface of the door safety locking knob 200 which inner surface is exposed to the cabin defined in the motor vehicle. A first rod connecting part 220 to which a first rod 641 is connected, and a pair of second stoppers 230 for controlling a rotating angle of the door safety locking knob 200, are formed on an outer surface of the door safety locking knob 200.

The entire inner handle 120 has substantially a 90°-rotated 'U'-shaped configuration. A knob part 121 is formed at a bottom portion of the 'U'-shaped configuration. Both ends 122 of the inner handle 120 are inserted into the pair of inserting holes 112, respectively, defined through the housing 110, in a manner such that the knob part 121 is received in the inner handle receiving recess 111. Both ends 122 of the inner handle 120 project out of the outer surface of the housing 110 so that both ends 122 of the inner handle 120 can be rotated about first and second hinge shafts A and B, respectively. A second rod connecting part 122*a* to which a second rod 611 is connected, is formed on the lower end 122 of the inner handle 120.

The inner handle operation control mechanism 130 includes a rotating member 133, a spring fastening segment 131 and a first torsion spring 132. The rotating member 133 is opened at an upper end thereof. The rotating member 133 is defined, on a circumferential outer surface thereof, with a first spring end projecting hole 133*b* and, on a lower surface thereof, with a resting groove 133*a* in which the upper end 122 of the inner handle 120 is fittedly engaged. The rotating member 133 is integrally rotated with the upper end 122 of the inner handle 120. A second fastening part 131*a* which has prominences and depressions, is formed on an upper surface of the spring fastening segment 131, in a manner such that the second fastening part 131*a* is meshed with the first fastening part 113*a* of the housing 110. A second spring end projecting hole 131*b* is defined on a circumferential outer surface of the spring fastening segment 131. The spring fastening segment 131 is fitted into the rotating member 133 which is opened at the upper end thereof as described above, in such a way as to be engaged with and thereby fastened to the first fastening part 113*a*. The first torsion spring 132 is seated on the spring fastening segment 131. Both ends of the first torsion spring 132 project through the first spring end projecting hole 133*b* of the rotating member 133 and the second spring end projecting hole 131*b* of the spring fastening segment 131, so as to be elastically supported therein. The inner handle operation control mechanism 130 which is structured as described above, is fitted between the upper end 122 of the inner handle 120 and the upper hinge connecting part 113 having the first fastening part 113*a* which is located above the upper end 122 of the inner handle 120, so as to be fastened by the medium of the first hinge shaft A.

Figure 3A:
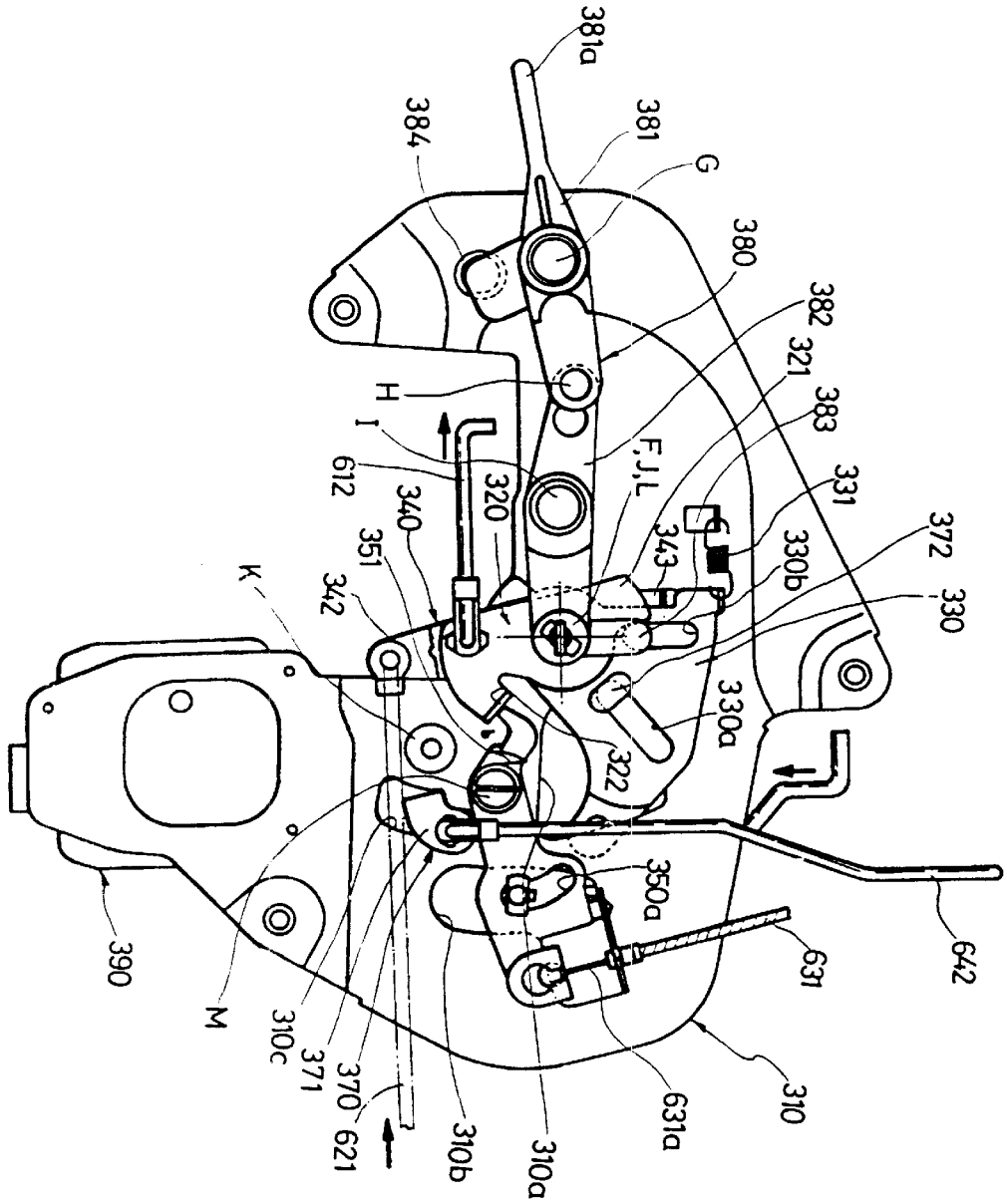
FIG. 3*a* is a front view illustrating a locking controller of FIG. 1.
Figure 3B:
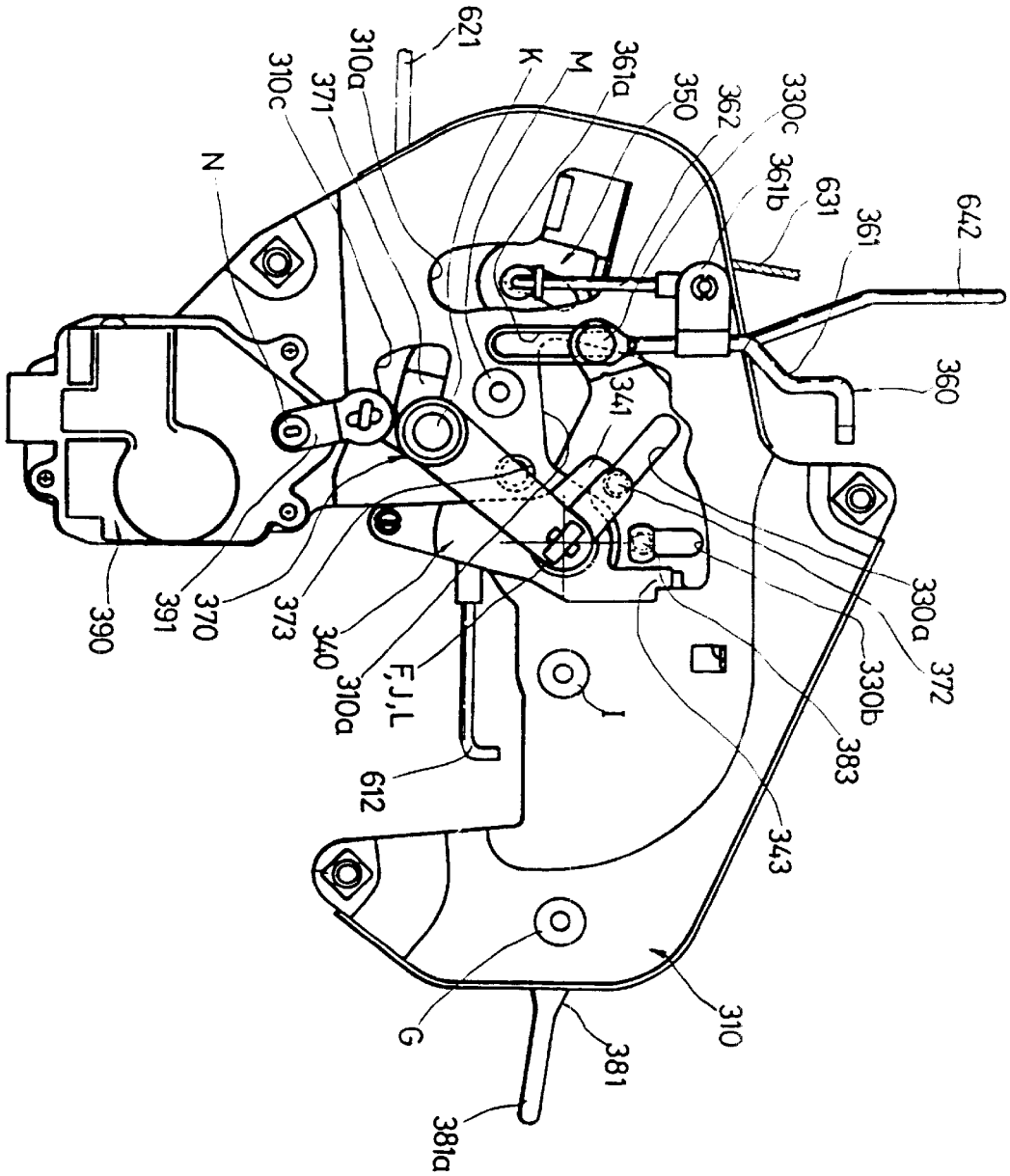
FIG. 3*b* is a rear view illustrating the locking controller of FIG. 1.

FIG. 3*a* is a front view illustrating the locking controller of FIG. 1; and FIG. 3*b* is a rear view illustrating the locking controller of FIG. 1. The locking controller 300 includes a base 310 which is formed with a plurality of locking parts and is defined with first through third guide openings 310*a*, 310*b* and 310*c*, an inner handle link 320, an operation controlling link 330 and a door-closed-status holding mechanism link 340 which are rotated about a third hinge shaft F, a door-opened-status holding mechanism link 350 which is rotated about a fourth hinge shaft M, an outside handle mechanism 360 which is reciprocated upward and downward, a door closing mechanism 370 which is rotated about a fifth hinge shaft K, a door opening prevention mechanism 380 which is rotated about a sixth hinge shaft G, and an actuator 390 which electrically controls an operation of the door closing mechanism 370. These component elements which constitute the locking controller 300, are operatively interlocked one with another.

Describing in detail locations and structures of the respective component elements which are used in this preferred embodiment of the present invention, first, the inner handle link 320 is fastened to a front surface of the base 310 in a manner such that the inner handle link 320 can be rotated about the third hinge shaft F. The inner handle link 320 is connected, in an interlocked manner, to the second rod connecting part 122*a* of the inner handle 120, by the medium of a first power transferring member 610 (not illustrated in its entirety) which is composed of rods 161 and 162, links (not shown), and so forth.

The operation controlling link 330 is defined with first and second guide slots 330*a* and 330*b*, and is formed, at an end thereof, with a fastening projection 330*c*. The operation controlling link 330 is rotatably fastened between the base 310 and the inner handle link 320, by the medium of the third hinge shaft F. The fastening projection 330*c* projects out of a rear surface of the base 310 after passing through the first guide opening 310*a* which is defined in the base 310. The operation controlling link 330 is elastically supported by the base 310 by the medium of a coil spring 331.

The door-closed-status holding mechanism link 340 is fastened to the rear surface of the base 310 in a manner such that it can be rotated about the third hinge shaft F. The door-closed-status holding mechanism link 340 is connected to the door-closed-status holding mechanism 400 by the medium of a second power transferring member 620 (see FIG. 1) which is composed of a third rod 621 and links (not shown), and so forth. The door-closed-status holding mechanism link 340 is formed, at one end thereof, with a third rod connecting part 342 which projects out of the front surface of the base 310. A curved surface of the third rod connecting part 342 is brought into contact with an edge portion of the base 310. A third stopper 343 is formed on the other end of the door-closed-status holding mechanism link 340 which the other end is located on the rear surface of the base 310. The third stopper 343 is fitted through the operation controlling link 330 adjacent to the coil spring 331 and through the first guide opening 310*a* defined in the base 310. The door-closed-status holding mechanism link 340 has an engaging projection 341 which projects between the third rod connecting part 342 and the third stopper 343 in such a way as to be located adjacent to a rear end of the base 310. The engaging projection 341 is placed parallel to a sliding surface of the first guide slot 330*a* of the operation controlling link 330.

The door-opened-status holding mechanism link 350 is fastened to the front surface of the base 310 in a manner such that it can be rotated about the fourth hinge shaft M. The door-opened-status holding mechanism link 350 is connected to the door-opened-status holding mechanism 500 by the medium of a third power transferring member 630 (see FIG. 1) which is composed of a cable 631, and so forth, and is elastically supported by the fourth hinge shaft M by the medium of a second torsion spring 351. The door-opened-status holding mechanism link 350 is defined with a third guide slot 350*a* through which an auxiliary rod 362 constituting the outside handle mechanism 360 is movably inserted.

The outside handle mechanism 360 comprises an outside handle connecting rod 361 and the auxiliary rod 362. A fourth guide slot 361*a* through which the fastening projection 330*c* of the operation controlling link 330 is movably inserted, is defined at a lower end of the outside handle connecting rod 361. A second locking part 361*b* is projectedly formed on a portion of a circumferential outer surface of the outside handle connecting rod 361. An upper end of the outside handle connecting rod 361 is directly connected to the outside handle or is indirectly connected to the outside handle by the medium of a separate fourth power transferring member (not shown), to be located on the rear surface of the base 310. One end of the auxiliary rod 362 is hingedly fastened to the second locking part 361*b* of the outside handle connecting rod 361. The other end of the auxiliary rod 362 is bent toward the front surface of the base 310 and is movably inserted into the third guide slot 350*a* of the door-opened-status holding mechanism link 350 after passing through the second guide opening 310*b* defined in the base 310.

The door closing mechanism 370 comprises a knob connecting link 371, a first locking member 372 and a third torsion spring 373. The knob connecting link 371 is fastened to the rear surface of the base 310 in a manner such that it can be rotated about the fifth hinge shaft K. The knob connecting link 371 is connected to the door safety locking knob 200, by the medium of a fifth power transferring member 640 (not illustrated in its entirety) which is composed of the first rod 641 and a fourth rod 642, links (not shown), and so forth. One end of the knob connecting link 371 to which one end the fourth rod 642 is rotatably connected, is bent in such a way as to project out of the front surface of the base 310 after passing through the third guide opening 310*c* defined in the base 310. One end of the first locking member 372 is fastened to the other end of the knob connecting link 371 which the other end is located on the rear surface of the base 310, in a manner such that the first locking member 372 can be rotated about a seventh hinge shaft L. The other end of the first locking member 372 is movably inserted into the first guide slot 330*a* of the operation controlling link 330 through the first guide opening 310*a* defined in the base 310. Both ends of the third torsion spring 373 are fastened to the base 310 and the knob connecting link 371, respectively, so as to enable an operation of the knob connecting link 371 to be systematically performed.

The door opening prevention mechanism 380 comprises first and second links 381 and 382, a second locking member 383 and a fourth torsion spring 384. The first link 381 is fastened to the front surface of the base 310 in a manner such that it can be rotated about the sixth hinge shaft G. One end of the first link 381 is formed with a knob part 381*a*. The second link 382 is fastened to the front surface of the base 310 in a manner such that it can be rotated about an eighth hinge shaft I. One end of the second link 382 is fastened to the other end of the first link 381 which the other end is opposed to the knob part 381*a*, in a manner such that one end of the second link 382 can be rotated about a ninth hinge shaft H. One end of the second locking member 383 is fastened to the other end of the second link 382 which the other end is opposed to the ninth hinge shaft H, in a manner such that one end of the second locking member 383 can be rotated about a tenth hinge shaft J. The other end of the second locking member 383 is movably inserted into the second guide slot 330*b* of the operation controlling link 330 after extending beyond one end 321 of the inner handle link 320, so as to be located in the first guide opening 310*a* defined in the base 310. Both ends of the fourth torsion spring 384 are fastened to the base 310 and the first link 381, respectively, so as to enable an operation of the first link 381 to be systematically performed. While it is described in the above embodiment that the door opening prevention mechanism 380 is constituted by two links 381 and 382 which are operatively interlocked with each other, it can be contemplated that a link is fastened to the front surface of the base 310 in such a way as to be capable of being rotated about a hinge shaft, one end of the link is formed with the knob part 381*a,* and the second locking member 383 is rotatably installed on the other end of the link by the medium of the tenth hinge shaft J, whereby an operation of the second locking member 383 can be controlled by the single link.

The actuator 390 is connected to the knob connecting link 371 by the medium of an actuator connecting member 391 in a state wherein the actuator 390 is fastened to the base 310. One end of the actuator connecting member 391 is fastened to a driving shaft N, and the other end of the actuator connecting member 391 is fastened to the knob connecting link 371 in a manner such that it can be rotated about an eleventh hinge shaft O.

Figure 4A:
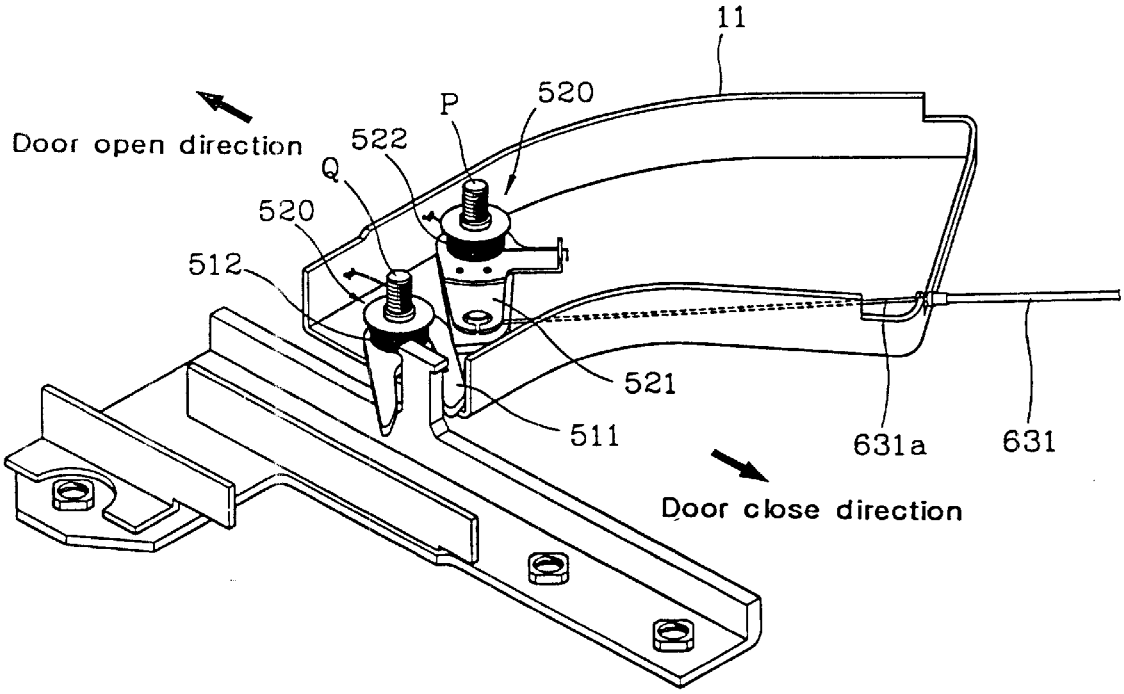
FIGS. 4*a* and 4*b* are perspective views for explaining operations of a door-opened-status holding mechanism of FIG. 1.
Figure 4B:
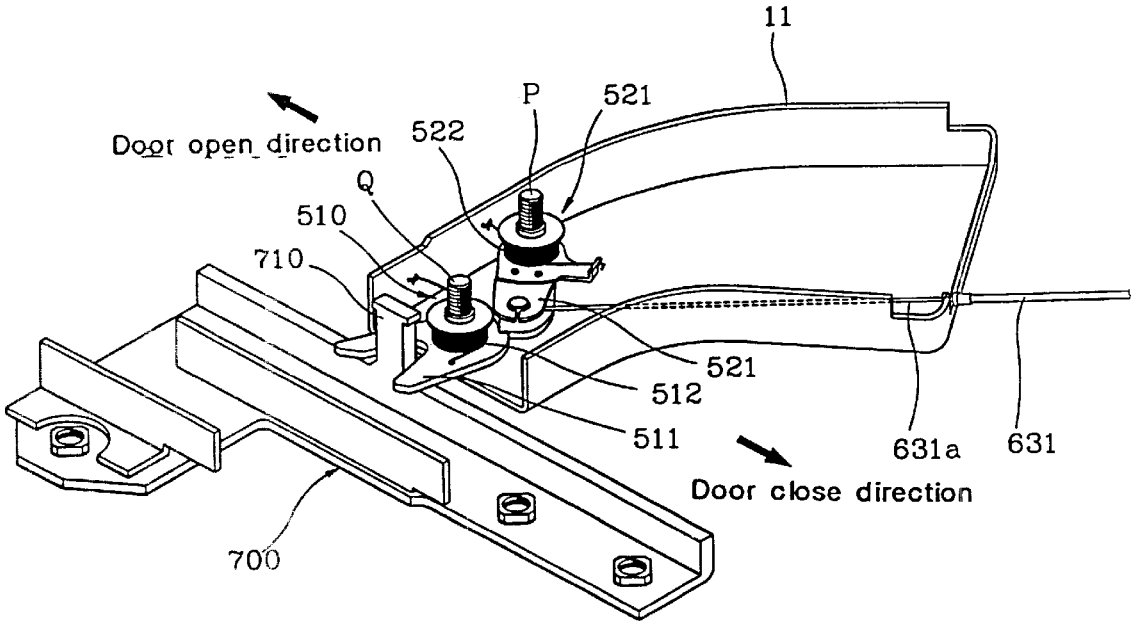

A structure of the door-opened-status holding mechanism 500 is well known in the art. Referring to FIGS. 4*a* and 4*b,* the door-opened-status holding mechanism 500 comprises an engaging mechanism section 510 and an operation controlling mechanism section 520. The engaging mechanism section 510 is engaged with a projected part 710 of a vehicle body structure 700. The operation controlling mechanism section 520 is connected to the door-opened-status holding mechanism link 350 of the locking controller 300 by the medium of the cable 631, and thereby is operated to disengage the engaging mechanism section 510 and the projected part 710 from each other. The engaging mechanism section 510 and the operation controlling mechanism section 520 are installed in a lower door structure 11 of the sliding door 10 in such a way as to be operatively interlocked with each other.

The engaging mechanism section 510 includes an engaging link 511 and a fifth torsion spring 512. The engaging link 511 is fastened to the lower door structure 11 in a manner such that it can be rotated about a first rotation shaft Q. The engaging link 511 is engaged with the projected part 710 of the vehicle body structure 700. The fifth torsion spring 512 functions to bias the engaging link 511 in one direction. The operation controlling mechanism section 520 includes a locking link 521 and a sixth torsion spring 522. The locking link 521 is fastened to the lower door structure 11 in a manner such that it can be rotated about a second rotation shaft P. The locking link 521 is connected to a wire 631*a* of the cable 631 so as to control an operation of the engaging link 511. The sixth torsion spring 522 functions to bias the locking link 521 in one direction.

In the meanwhile, since a structure and an operation of the door-closed-status holding mechanism 400 are well known in the art, detailed descriptions therefor will be omitted herein.

FIGS. 2*a* and 2*b* illustrate a state wherein the pressing part 210 of the door safety locking knob 200 is pressed leftward, thereby the door safety locking knob 200 is maintained in an OFF state, and the inner handle 120 is maintained in the neutral position by returning force of the first torsion spring 132. FIGS. 3*a* and 3*b* illustrate a state corresponding to the state shown in FIGS. 2*a* and 2*b,* wherein the door opening prevention mechanism 380 is maintained in an OFF state.

Hereinafter, operations of the system for opening and closing a sliding door according to the present invention, constructed as mentioned above, will be described in detail, on the assumption that the sliding door 10 is held in the closed status under conditions shown in FIGS. 2*a* and 3*b*.

In a state wherein the sliding door 10 is closed, if an occupant pushes or pulls the inner handle 120 in a door opening direction, the inner handle 120 is rotated about the first and second hinge shafts A and B in the door opening direction, and thereby, the second rod 611 which is connected to the second rod connecting part 122*a* of the inner handle 120, is pulled. By this, as a fifth rod 612 of the locking controller 300 which fifth rod is connected to the second rod 611, is pulled, the inner handle link 320 is rotated about the third hinge shaft F in a clockwise direction (see FIG. 3*a*), and the one end 321 of the inner handle link 320 forces the second locking member 383 of the door opening prevention mechanism 380 in the clockwise direction. Then, as the second locking member 383 is rotated about the tenth hinge shaft J in the clockwise direction, the operation controlling link 330 is rotated about the third hinge shaft F in the clockwise direction, and by the operation controlling link 330, the first locking member 372 of the door closing mechanism 370 is rotated about the seventh hinge shaft L in the clockwise direction. Thereafter, the first locking member 372 forces the engaging projection 341 of the door-closed-status holding mechanism link 340 in the clockwise direction, and thereby, the door-closed-status holding mechanism link 340 is rotated about the third hinge shaft F in the clockwise direction. At this time, the fastening projection 330*c* of the operation controlling link 330 is reciprocated along the fourth guide slot 361*a* of the outside handle connecting rod 361. Accordingly, as the third rod 621 which is connected to the third rod connecting part 342 of the door-closed-status holding mechanism link 340, is pulled, engagement of the door-closed-status holding mechanism 400 which is connected to the third rod 621, is released, whereby the sliding door 10 can be opened.

After that, as the sliding door 10 is continuously opened, if the sliding door 10 reaches a predetermined position, the projected part 710 of the vehicle body structure 700 is fitted into the engaging link 511 of the door-opened-status holding mechanism 500 (see FIG. 4*a*). By this, the engaging link 511 is rotated in the clockwise direction. Next, as the locking link 521 is rotated in the clockwise direction by returning force of the sixth torsion spring 522, the locking link 521 is engaged with the engaging link 511 to be maintained in a state as shown in FIG. 4*b*.

On the other hand, if the inner handle 120 is pivoted in one direction, because one end of the first torsion spring 132 is fastened to a side surface of the second spring end projecting hole 131*b* of the spring fastening segment 131, and the other end of the first torsion spring 132 is pressed by the other end of the first spring end projecting hole 133*b* of the rotating member 133, as the occupant releases the inner handle 120, the inner handle 120 is returned to its neutral position by the returning force of the first torsion spring 132. Also, due to the fact that the operation controlling link 330 is rotated in a counterclockwise direction by returning force of the coil spring 331 and is returned to its original position, the first locking member 372 of the door closing mechanism 370 and the second locking member 383 of the door opening prevention mechanism 380 which are fittedly fastened to the first and second guide slots 330*a* and 330*b* of the operation controlling link 330, respectively, are also rotated in the counterclockwise direction along with the operation controlling link 330 and returned to their original positions. Thus, as the third stopper 343 of the door-closed-status holding mechanism link 340 and the one end 321 of the inner handle link 320 which are connected to the first and second locking members 372 and 383, respectively, are pushed in the counterclockwise direction, the door-closed-status holding mechanism link 340 and the inner handle link 320 are rotated in the counterclockwise direction and returned to their original positions. Hence, as the third rod 621 which is connected to the third rod connecting part 342 of the door-closed-status holding mechanism link 340, is pushed, the door-closed-status holding mechanism 400 which is connected to the third rod 621, is maintained in an engagement standby status.

On the contrary, as shown in FIG. 4*b*, in a state wherein the sliding door 10 is opened to the predetermined position and the door-opened-status holding mechanism 500 is maintained in an engaged status, if the occupant pushes or pulls the inner handle 120 in a door closing direction, the inner handle 120 is rotated about the first and second hinge shafts A and B in the door closing direction, and thereby, the second rod 611 which is connected to the second rod connecting part 122*a* of the inner handle 120, is pushed. By this, as the fifth rod 612 of the locking controller 300 which fifth rod is connected to the second rod 611, is pushed, the inner handle link 320 is rotated about the third hinge shaft F in the counterclockwise direction (see FIG. 3*a*). As the other end 322 of the inner handle link 320 pushes one end of the door-opened-status holding mechanism link 350, the door-opened-status holding mechanism link 350 is rotated about the fourth hinge shaft M in the clockwise direction, and thereby, the wire 631*a* of the cable 631 which is connected to the door-opened-status holding mechanism link 350, is pulled. According to this, as the locking link 521 of the door-opened-status holding mechanism 500, which locking link is connected to the wire 631*a* of the cable 631, is rotated in the counterclockwise direction, engagement between the engaging link 511 and the locking link 521 is released, whereby the sliding door 10 can be moved in the door closing direction. At this time, a lower end of the auxiliary rod 362 which is inserted into the third guide slot 350*a* of the door-opened-status holding mechanism link 350, is fixedly maintained, and the door-opened-status holding mechanism link 350 having the third guide slot 350*a* is rotated about the fourth hinge shaft M.

After that, as the sliding door 10 is moved in the door closing direction, the engaging link 511 which is engaged with the projected part 710 of the vehicle body structure 700, is pivoted in the door opening direction, and the engaging link 511 is rotated about the first rotation shaft Q (see FIG. 4*a*). Thereby, the engaging link 511 is maintained in an engagement standby status by virtue of returning force of the fifth torsion spring 512. As the sliding door 10 is continuously moved in the door closing direction, if the sliding door 10 reaches a door closed position, engagement of the door-closed-status holding mechanism 400 is effected, whereby the sliding door 10 is held in the closed status.

Further, if the outside handle of the sliding door 10 is manipulated, as the outside handle connecting rod 361 is pressed downward, the auxiliary rod 362 which is connected thereto, is correspondingly pressed downward. The operation controlling link 330 which is inserted through an upper end of the fourth guide slot 361*a* of the outside handle connecting rod 361, and the door-opened-status holding mechanism link 350 having the third guide slot 350*a* through which the lower end of the auxiliary rod 362 is inserted, are simultaneously pushed downward by the outside handle connecting rod 361 and the auxiliary rod 362. By this, as the operation controlling link 330, the first locking member 372 of the door closing mechanism 370, and the door-closed-status holding mechanism link 340 are rotated in the clockwise direction, the door-opened-status holding mechanism link 350 is rotated in the clockwise direction, whereby the door-closed-status holding mechanism 400 and the door-opened-status holding mechanism 500 are simultaneously unlocked.

In a state as shown in FIGS. 2*a* and 3*b*, if the occupant pushes leftward the pushing part 210 of the door safety locking knob 200 and thereby the door safety locking knob 200 is switched to an ON state, the door safety locking knob 200 is rotated in the door opening direction, and the first rod 641 which is connected to the first rod connecting part 220, is pulled. By this, as the fourth rod 642 of the locking controller 300 which fourth rod is connected to the first rod 641, is pushed downward, the knob connecting link 371 of the door closing mechanism 700 is rotated about the fifth hinge shaft K in the clockwise direction (see FIG. 3*a*). And, as the seventh hinge shaft L which is arranged at the other end of the knob connecting link 371 located on the rear surface of the base 310, is moved in the clockwise direction (counterclockwise direction in the case of FIG. 3*b*), the seventh hinge shaft L pushes the first locking member 372. By this, the first locking member 372 is lifted upward along the first guide slot 330*a* of the operation controlling link 330. Due to the fact that positions of both ends of the third torsion spring 373 are differentiated from each other when viewed from a center of the third torsion spring 373, the third torsion spring 373 which is fastened at both ends thereof to the knob connecting link 371 and the base 310, respectively, elastically supports the knob connecting link 371, so as to enable the operation of the knob connecting link 371 to be systematically performed, whereby the door safety locking knob 200 is maintained in the ON state by the third torsion spring 373.

Hereinbelow, operations of the system for opening and closing a sliding door according to the present invention, will be described in detail, considering a condition in which the door safety locking knob 200 is switched to the ON state.

First, in the state wherein the sliding door 10 is closed, if the occupant pushes or pulls the inner handle 120 in the door opening direction, the inner handle 120 is rotated about the first and second hinge shafts A and B in the door opening direction, and thereby, the second rod 611 which is connected to the second rod connecting part 122*a* of the inner handle 120, is pulled. By this, as the fifth rod 612 of the locking controller 300 which fifth rod is connected to the second rod 611, is pulled, the inner handle link 320 is rotated about the third hinge shaft F in the clockwise direction (see FIG. 3*a*), and the one end 321 of the inner handle link 320 forces the second locking member 383 of the door opening prevention mechanism 380 in the clockwise direction. Then, as the second locking member 383 is rotated about the tenth hinge shaft J in the clockwise direction, the operation controlling link 330 is rotated about the third hinge shaft F in the clockwise direction, and by the operation controlling link 330, the first locking member 372 of the door closing mechanism 370 is rotated about the seventh hinge shaft L in the clockwise direction. By the fact that the first locking member 372 is pushed upward along the first guide slot 330*a* of the operation controlling link 330 and is separated from the engaging projection 341 of the door-closed-status holding mechanism link 340, power transfer to the door-closed-status holding mechanism link 340 is interrupted, and thereby, the door-closed-status holding mechanism link 340 is maintained in a stopped state. Therefore, even though the inner handle 120 is pivoted in the door opening direction while the door safety locking knob 200 is maintained in the ON state, the sliding door 10 is not willing to be opened.

On the contrary, in the state wherein the sliding door 10 is opened to the predetermined position and the door-opened-status holding mechanism 500 is maintained in the engaged status, if the occupant pushes or pulls the inner handle 120 in the door closing direction, the inner handle 120 is rotated about the first and second hinge shafts A and B in the door closing direction, and the inner handle link 320 is rotated about the third hinge shaft F in the counterclockwise direction (see FIG. 3*a*). In this case, because the inner handle link 320 is not interfered by any component elements and the door-opened-status holding mechanism link 350 is interlocked with the inner handle link 320 separately from the door closing mechanism 370, engagement between the engaging link 511 and the locking link 521 of the door-opened-status holding mechanism 500 is released, and thereby, the sliding door 10 can be moved in the door closing direction. Thereafter, if the sliding door 10 reaches the door closed position, as engagement of the door-closed-status holding mechanism 400 is effected, the sliding door 10 is held in the closed status. The sliding door 10 which is closed in this way, is not willing to be opened even though the inner handle 120 is pivoted in the door opening direction.

Further, if the outside handle of the sliding door 10 is manipulated, as the outside handle connecting rod 361 is pressed downward, the auxiliary rod 362 which is connected thereto, is correspondingly pressed downward. The operation controlling link 330 which is inserted through the upper end of the fourth guide slot 361*a* of the outside handle connecting rod 361, and the door-opened-status holding mechanism link 350 having the third guide slot 350*a* through which the lower end of the auxiliary rod 362 is inserted, are simultaneously pushed downward by the outside handle connecting rod 361 and the auxiliary rod 362. By this, as the operation controlling link 330 and the first locking member 372 of the door closing mechanism 370 are rotated in the clockwise direction, the door-opened-status holding mechanism link 350 is rotated in the clockwise direction. Thus, since power transfer to the door-closed-status holding mechanism 400 is interrupted, engagement of the door-opened-status holding mechanism 500 is released and the door-closed-status holding mechanism 400 is maintained in the engaged status.

In the state as shown in FIGS. 2*a* and 3*b,* if the occupant pushes upward the knob part 381*a* of the door opening prevention mechanism 380 and thereby the door opening prevention mechanism 380 is switched to an ON state, the first link 381 is rotated about the sixth hinge shaft G in the clockwise direction (see FIG. 3), and the second link 382 which is connected to the first link 381 by the medium of the ninth hinge shaft H, is rotated in the counterclockwise direction to push upward the second locking member 383. By this, the second locking member 383 is pushed upward along the second guide slot 330*b* of the operation controlling link 330. Due to the fact that positions of both ends of the fourth torsion spring 384 are differentiated from each other when viewed from a center of the fourth torsion spring 384, the fourth torsion spring 384 which is fastened at both ends thereof to the first link 381 and the base 310, respectively, elastically supports the first link 381, so as to enable the operation of the first link 381 to be systematically performed, whereby the door opening prevention mechanism 380 is maintained in the ON state by the fourth torsion spring 384.

Hereinbelow, operations of the system for opening and closing a sliding door according to the present invention, will be described in detail, considering another condition in which the door opening prevention mechanism 380 is switched to the ON state.

First, in the state wherein the sliding door 10 is closed, if the occupant pushes or pulls the inner handle 120 in the door opening direction, the inner handle 120 is rotated about the first and second hinge shafts A and B in the door opening direction, and thereby, the second rod 611 which is connected to the second rod connecting part 122*a* of the inner handle 120, is pulled. By this, as the fifth rod 612 of the locking controller 300 which fifth rod is connected to the second rod 611, is pulled, the inner handle link 320 is rotated about the third hinge shaft F in the clockwise direction (see FIG. 3*a*). At this time, by the fact that the second locking member 383 is pushed upward along the second guide slot 330*b* of the operation controlling link 330 in such a way as to be separated from the one end 321 of the inner handle link 320, power transfer to the operation controlling link 330 by the medium of the second locking member 383 is interrupted, whereby the operation controlling link 330 and the door-closed-status holding mechanism link 340 are maintained in the stopped state. Therefore, even though the inner handle 120 is pivoted in the door opening direction while the door safety locking knob 200 is maintained in the ON state, the sliding door 10 is not willing to be opened.

On the contrary, in the state wherein the sliding door 10 is opened to the predetermined position and the door-opened-status holding mechanism 500 is maintained in the engaged status, if the occupant pushes or pulls the inner handle 120 in the door closing direction, the inner handle 120 is rotated about the first and second hinge shafts A and B in the door closing direction, and the inner handle link 320 is rotated about the third hinge shaft F in the counterclockwise direction (see FIG. 3*a*). In this case, because the inner handle link 320 is not interfered by any component elements and the door-opened-status holding mechanism link 350 is interlocked with the inner handle link 320 separately from the door opening prevention mechanism 380, engagement between the engaging link 511 and the locking link 521 of the door-opened-status holding mechanism 500 is released, and thereby, the sliding door 10 can be moved in the door closing direction. Thereafter, if the sliding door 10 reaches the door closed position, as engagement of the door-closed-status holding mechanism 400 is effected, the sliding door 10 is held in the closed status. The sliding door 10 which is closed in this way, is not willing to be opened even though the inner handle 120 is pivoted in the door opening direction.

Further, if the outside handle of the sliding door 10 is manipulated, as the outside handle connecting rod 361 is pressed downward, the auxiliary rod 362 which is connected thereto, is correspondingly pressed downward. The operation controlling link 330 which is inserted through the upper end of the fourth guide slot 361*a* of the outside handle connecting rod 361, and the door-opened-status holding mechanism link 350 having the third guide slot 350*a* through which the lower end of the auxiliary rod 362 is inserted, are simultaneously pushed downward by the outside handle connecting rod 361 and the auxiliary rod 362. By this, as the operation controlling link 330, the first locking member 372 of the door closing mechanism 370 and the door-closed-status holding mechanism link 340 are rotated in the clockwise direction, the door-opened-status holding mechanism link 350 is rotated in the clockwise direction. Thus, the door-closed-status holding mechanism 400 and the door-opened-status holding mechanism 500 are simultaneously unlocked irrespective of ON/OFF states of the door opening prevention mechanism 380.

In the present invention, in the state wherein the sliding door 10 is closed, if the occupant pushes or pulls the inner handle 120 in the door opening direction, as the inner handle 120 is pivoted from the neutral position in the door opening direction, the door-closed-status holding mechanism 400 is unlocked by the locking controller 300. Also, in the state wherein the sliding door 10 is opened, if the occupant pushes or pulls the inner handle 120 in the door closing direction, as the inner handle 120 is pivoted from the neutral position in the door closing direction, the door-opened-status holding mechanism 500 is unlocked by the locking controller 300. Therefore, opening and closing of the sliding door 10 can be implemented by a single directional manipulation which turns over the inner handle 120 in the door opening direction or door closing direction.

Also, in the state wherein the door safety locking knob 200 of the sliding door 10 is manipulated, if the outside handle is manipulated, the door-opened-status holding mechanism 500 is unlocked by the locking controller 300, and the door-closed-status holding mechanism 400 is maintained in the engaged status. If the knob part 381*a* of the door opening prevention mechanism 380 which is provided in the locking controller 300 of the sliding door 10, is manipulated, even though the inner handle 120 is pivoted in the door opening direction while the sliding door 10 is held in the closed status, the door-closed-status holding mechanism 400 is maintained in the engaged status. At this time, in the case that the outside handle is manipulated, the door-closed-status holding mechanism 400 is unlocked. As a consequence, opening and closing of the sliding door 10 using the outside handle is possible, and safety devices such as the door safety locking knob 200 and the door opening prevention mechanism 380 adequately act in an interlocked manner with the inner handle 120 and the outside handle. Furthermore, since the operation of the knob connecting link 371 can be automatically controlled by the medium of the actuator 390, all functions of the conventional system for opening and closing a sliding door are reserved.

As a result, the system for opening and closing a sliding door, according to the present invention, provides advantages in that, if an inner handle is pivoted in a door opening direction or a door closing direction, as the inner handle is pivoted in the door opening direction or the door closing direction, a door-opened-status holding mechanism or a door-closed-status holding mechanism is unlocked. Consequently, when an occupant simply applies force to the inner handle in one direction, a sliding door can be opened or closed in an easy manner, whereby occupant convenience is remarkably improved.

In the drawings and specification, there have been disclosed typical preferred embodiments of the invention and, although specific terms are employed, they are used in a generic and descriptive sense only and not for purposes of limitation, the scope of the invention being set forth in the following claims.

What is claimed is:

1. A system for opening and closing a sliding door, the system comprising:

an inner handle assembly for operating the sliding door between a door open position and a door closed position, the inner handle assembly further comprising;

an inner handle having a neutral position, door opening position and a door closing position;

an inner handle housing demountably attached to an inner side of the sliding door; the inner handle housing having an inner handle seating space and a separate locking knob insertion hole spaced from and located relatively higher on the inner handle housing than the inner handle seating space;

a door locking knob having a locked position and an unlocked position rotatably defined by an angle of rotation of the locking knob about a hinge shaft located within the knob insertion hole;

a stopper for controlling the angle of rotation of the door locking knob;

a door closed holding mechanism for releasably locking the sliding door in the door closed position;

a door open holding mechanism for releasably locking the sliding door in the door open position;

a locking controller interposed between the inner handle and the door closed and open holding mechanisms; the locking controller further comprising;

a housing containing an inner handle link directly operated by the inner handle via a first power transmission member, the inner handle link being rotatably fixed to the housing for rotation in both a clockwise and counterclockwise directions about a first hinge shaft (F);

an operation controlling link rotatably fixed to the housing about the first hinge shaft (F) in an original position and directly rotatable by the inner handle link to a second position and the operation controlling link being returned to the original position by the restitutive force of a first spring spaced form the first hinge shaft and biasly connecting the operation controlling link to the housing;

a door-close maintaining link rotatably fixed to the housing about the first hinge shaft (F) in a first position and connected to a door-close maintaining means via the first power transmission member, the door-close maintaining link being selectively actuated into a second position by the operation controlling link solely during an opening operation of the sliding door, and the door-dose maintaining link being returned to the first position by the operation controlling link;

a door-open maintaining link rotatably fixed to the housing on a second hinge shaft (M) in a first position, the door-open maintaining link being connected to a door-open maintaining means via a second power transmission member, the door-open maintaining link being actuated into a second position solely during a closing operation of the sliding door upon rotation of the inner handle link in a counterclockwise direction, the door-open maintaining link being returned to the first position by the restitutive force of a second spring; and when the sliding door is in the door closed position and the inner handle is pivoted from the neutral position to the door opening position the door closed holding mechanism is released by a locking controller; and when the sliding door is in the door open position and the inner handle is pivoted from the neutral position to the door closing position, the door open holding mechanism is unlocked by the locking controller.

2. A system for opening and closing a sliding door, the system comprising:

an inner handle assembly for operating the sliding door between a door open position and a door closed position, the inner handle assembly further comprising:

an inner handle having a neutral position, a door opening position and a door closing position;

a housing demountably attached to an inner side of the sliding door; the housing having an inner handle seating space and a separate locking knob insertion hole spaced from and located relatively higher on the housing than the inner handle seating space;

a door locking knob having a locked position and an unlocked position rotatably defined by an angle of rotation of the locking knob about a hinge shaft located within the knob insertion hole;

a stopper for controlling the angle of rotation of the door locking knob;

the inner handle positioned within the inner handle seating space and hingedly connected to the housing to rotate in to the door opening and door closing positions about the neutral position;

the door locking knob having an operation portion formed on an exposed surface of the door locking knob and a rod connecting portion formed on a rear surface of the locking knob to attach a locking mechanism rod;

a door closed holding mechanism for releasably locking the sliding door in the door closed position;

a door open holding mechanism for releasably locking the sliding door in the door open position;

a locking controller interposed between the inner handle and the door closed and open holding mechanisms; and when the sliding door is in the door closed position and the inner handle is pivoted from the neutral position to the door opening position the door dosed holding mechanism is released by a locking controller; and when the sliding door is in the door open position and the inner handle is pivoted from the neutral position to the door closing position, the door open holding mechanism is unlocked by the locking controller.

3. The system for opening and closing a sliding door as set forth in claim 2, wherein the inner handle assembly further comprises an inner handle operation part having a rotational member and a fixed member, the rotational member being respectively rotated with an upper and lower ends of the inner handle, and the fixed member being held respectively stationary relative to the rotational member, and wherein the rotational member is provided with a first groove formed in an external surface and the fixed member is provided with a second groove;

a torsion spring seated in the handle operation part, the torsion spring having a first and second ends projected through the first groove of the rotational member and the second groove of the spring fixing member respectively and resiliently supported at both sides of the first and second grooves.

4. The system for opening and closing a sliding door as set forth in claim 3, wherein the inner handle operation part is inserted in the assembly via an upper hinge shaft extending between the upper end of the inner handle and a hinge connecting part affixed to the housing.

* * * * *